US006135457A

United States Patent [19]

Yiu

[11] Patent Number: 6,135,457

[45] Date of Patent: Oct. 24, 2000

[54] ZERO ZONE STRUCTURE FOR A DART BOARD

[76] Inventor: Chih-Hao Yiu, 6F-2, No. 160, Chung Kang Road, Sec. 1, Taichung, Taiwan

[21] Appl. No.: 09/263,567

[22] Filed: Mar. 8, 1999

[51] Int. Cl.[7] ..... F41J 3/00

[52] U.S. Cl. ..... 273/408; 273/348.5

[58] Field of Search ..... 273/403, 404, 273/407, 408, 348.5, 371–372

[56] References Cited

U.S. PATENT DOCUMENTS 5,613,686 3/1997 Yiu ..... 273/348.5

FOREIGN PATENT DOCUMENTS 1527631 10/1978 United Kingdom ..... 273/408

*Primary Examiner*—Mark S. Graham

*Attorney, Agent, or Firm*—Charles E. Baxley, Esq.

[57] ABSTRACT

A dart board includes a score portion and a zero zone, the zero zone having a plurality of apertures defined by longitudinal ridges and latitudinal ridges, each of the longitudinal ridges and latitudinal ridges has two inclined surfaces defined in two sides thereof so that when the dart hits the ridges, the tip of the dart will be guided into the apertures.

2 Claims, 4 Drawing Sheets

ZERO ZONE STRUCTURE FOR A DART BOARD

FIELD OF THE INVENTION

The present invention relates to a dart board, and more particularly, to a dart board whose zero zone has a plurality of longitudinal ridges and latitudinal ridges so as to define apertures therebetween, each of the longitudinal ridges and the latitudinal ridges having two inclined surfaces on its two sides so as to guide the dart to successfully penetrate in the apertures.

BACKGROUND OF THE INVENTION

FIG. 5 shows a section of a conventional dart board which includes a score portion (11) and a zero zone (12) located on the outer periphery of the score portion (11). The score portion (11) is divided into several sections (13) and each of which represents a pre-determined score, each of the sections (13) has a plurality of holes (14) so that when the dart penetrates the holes (14) in a specific section (13), the player gains the scores represented by the section (13). In the zero zone (12), there are apertures (15) defined therein for the dart to penetrate through the apertures (15). The locations of the apertures (15) are arranged along a straight horizontal line so that there could be no apertures (15) defined in the region close to the outer periphery of the score portion (11) and the periphery of the board so that when the dart hits these regions, the dart cannot attach to the board and will drop to the ground. The zero zone (12) occupies a certain area of the dart board so that the players throw the dart to these regions many times and the darts drop down. This will reduce the interesting of the players and could damage the tip of the darts.

The present invention intends to provide a zero zone structure for the dart board wherein the darts will be guided to attach to the zone by the inclined surfaces of the ridges defining the apertures in the zero zone.

The present invention has arisen to mitigate the drawbacks of the conventional dart board.

SUMMARY OF THE INVENTION

In accordance with one aspect of the present invention, there is provided a dart board comprising a score portion and a zero zone. The zero zone has a plurality of latitudinal ridges and a plurality of longitudinal ridges attached thereon so as to define a plurality of apertures between the latitudinal ridges and the longitudinal ridges. Each of the latitudinal ridges and the longitudinal ridges has two inclined surfaces defined in two sides thereof.

It is an object of the present invention to provide a dart board which has a plurality of latitudinal ridges and a plurality of longitudinal ridges to define a plurality of apertures therebetween, each of the ridges having two inclined surfaces defined in two sides thereof so that the tip of the dart will be guided into the apertures even if the dart hits on the ridges.

Another object of the present invention is to provide a dart board which increases the possibilities for the dart to be attached on the board.

Further features of the present invention will become apparent after a careful reading of the detailed description with appropriate reference to the accompanying drawings.

DETAILED DESCRIPTION OF THE PREFERRED EMBODIMENT

Figure 1:
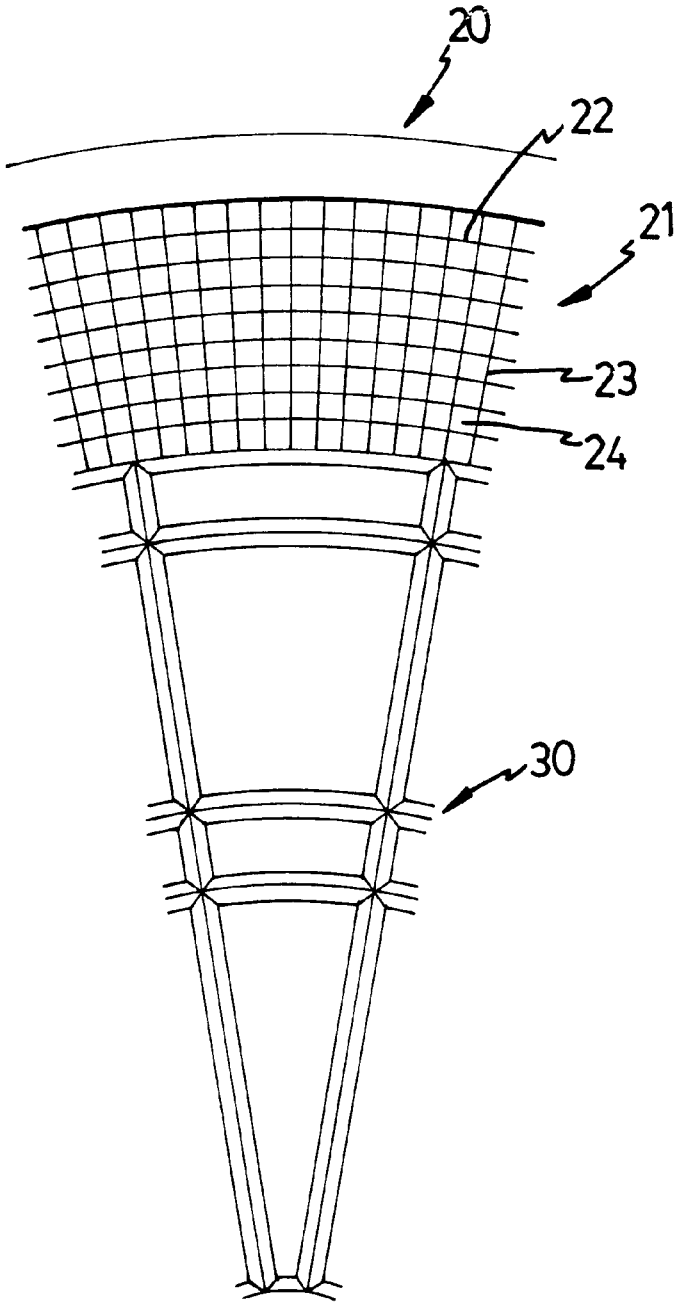
FIG. 1 is a front view to illustrate a section of the dart board of the present invention.
Figure 2:
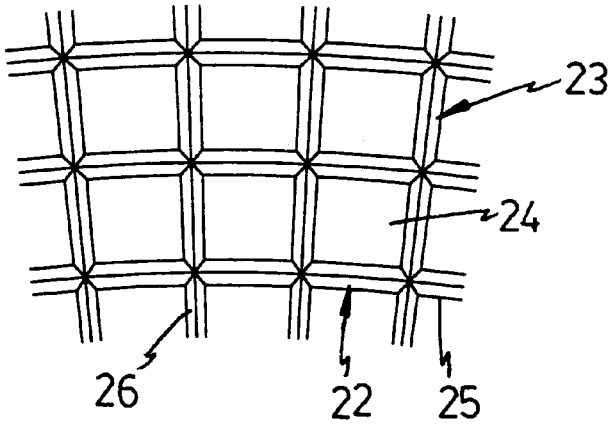
FIG. 2 is an illustrative view to illustrate the latitudinal ridges and the longitudinal ridges for defining the apertures therebetween.
Figure 3:
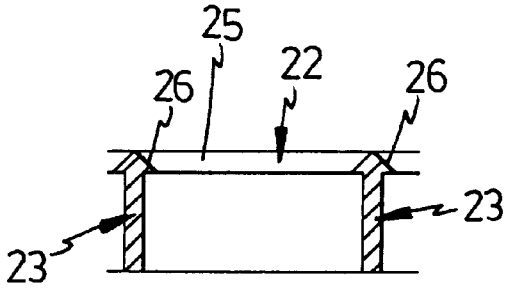
FIG. 3 is a side elevational view, partly in section, of the arrangement of the latitudinal ridges and the longitudinal ridges in accordance with the present invention.

Referring to FIGS. 1 to 3, the dart board (20) in accordance with the present invention comprises a score portion (30) and a zero zone (21). The zero zone (21) has a plurality of latitudinal ridges (22) and a plurality of longitudinal ridges (23) attached thereon so as to define a plurality of apertures (24) between the latitudinal ridges (22) and the longitudinal ridges (23). The apertures (24) are sized to fit the tip of the dart (not shown) so that when the dart hits the dart board (20), the dart is attached to the dart board (20). Each of the latitudinal ridges (22) and the longitudinal ridges (23) has two inclined surfaces (25/26) defined in two sides thereof. That is to say, the latitudinal ridges (22) and the longitudinal ridges (23) each have two inclined surfaces (25/26) toward the apertures (24) so that even if the dart hits the latitudinal ridges (22) or the longitudinal ridges (23), the tip of the dart will still be guided into the aperture (24) so that the dart that the players throw will not drop.

By the structure, the regions close to the periphery of the dart board (20) and the boundary portion between the zero zone (20) and the score portion (3) are easily arranged with apertures (24).

Because the latitudinal ridges (22) are curved (if the dart board is a circular board) so that the top side of each of the apertures (24) will be longer than the lower side of the aperture (24). In order to let all the apertures (24) have an even size, the width of each of the longitudinal ridges (23) is enlarged proportionally according to the radial distance from the center of the dart board (20) as shown in FIG. 2. Therefore, each of the apertures (24) in the dart board (20) will has the same size.

Figure 4:
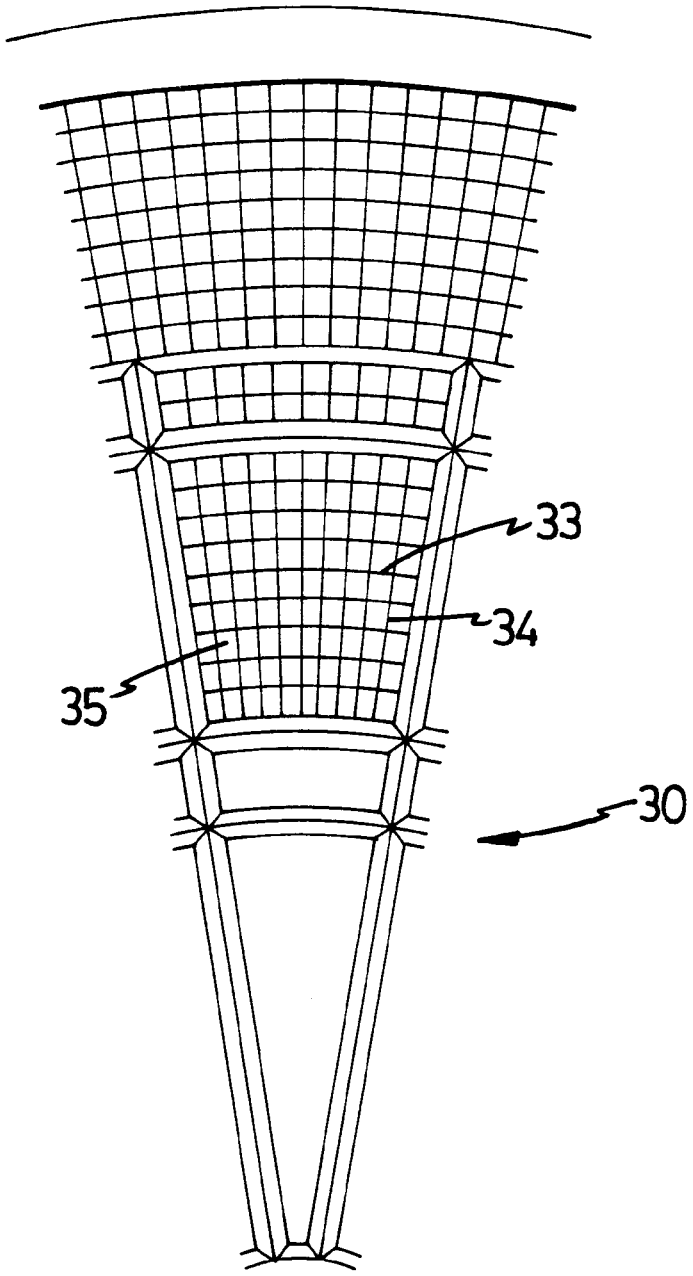
FIG. 4 is a front view to illustrate a section of the dart board of the present invention, wherein the latitudinal ridges and the longitudinal ridges each with two inclined surfaces are also used to define the apertures of the score portion of the dart board.
Figure 5:
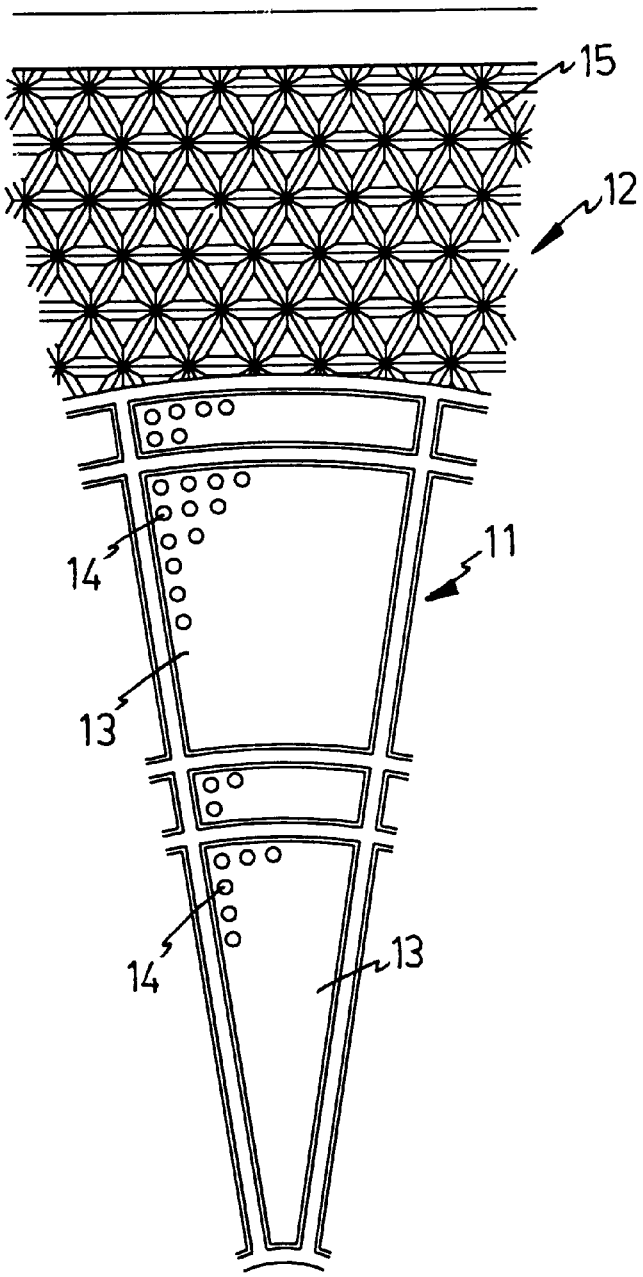
FIG.5 PRIOR ART
FIG. 5 is a front view to illustrate a section of the conventional dart board.

FIG. 4 shows that the apertures (35) in the score portion (30) are also defined by the latitudinal ridges (33) and the longitudinal ridges (34) both of which has the same shape as the latitudinal ridges (22) and the longitudinal ridges (23).

It is to be understood that the above description and drawings are only used for illustrating some embodiments of the present invention, not intended to limit the scope thereof. Any variation and derivation from the above description and drawings should be included in the scope of the present invention.

What is claimed is:

1. A dart board (20) comprising:

a score portion (30) and a zero zone (21), said zero zone (21) having a plurality of latitudinal ridges (22) and a plurality of longitudinal ridges (23) attached thereon so as to define a plurality of apertures (24) between said latitudinal ridges (22) and said longitudinal ridges (23), each of said latitudinal ridges (22) and said longitudinal ridges (23) having two inclined surfaces (25/26) defined in two sides thereof, a width of each of said longitudinal ridges (23) being enlarged proportionally according to a radial distance from a center of said dart board (20).

2. A dart board (20) comprising:

a score portion (30) and a zero zone (21), each of said score portion (30) and said zero zone (21) having a plurality of latitudinal ridges (22/33) and a plurality of longitudinal ridges (23/34) attached thereon so as to define a plurality of apertures (24/35) between said latitudinal ridges (22/33) and said longitudinal ridges (23/34), each of said latitudinal ridges (22/33) and said longitudinal ridges (23/34) having two inclined surfaces (25/26) defined in two sides thereof, a width of each of said longitudinal ridges (23/34) being enlarged proportionally according to a radial distance from a center of said dart board (20).

* * * * *